United States Patent [19]

Dalebout et al.

[11] Patent Number: 5,000,444

[45] Date of Patent: Mar. 19, 1991

[54] DUAL ACTION EXERCISE CYCLE

[75] Inventors: William T. Dalebout; Curt G. Bingham, both of Logan, Utah

[73] Assignee: Proform Fitness Products, Inc., Logan, Utah

[21] Appl. No.: 290,454

[22] Filed: Dec. 27, 1988

Related U.S. Application Data

[63] Continuation-in-part of Ser. No. 201,130, Jun. 2, 1988, which is a continuation-in-part of Ser. No. 201,129, Jun. 2, 1988.

[51] Int. Cl.[5] ..... A63B 21/00

[52] U.S. Cl. ..... 272/73; 272/130

[58] Field of Search ..... 272/71, 72, 73, 130, 272/132, 93; 128/25 R; 474/87; D21/191, 197

[56] References Cited

U.S. PATENT DOCUMENTS 4,537,396 8/1985 Hooper ..... 272/73
4,589,656 5/1986 Baldwin ..... 272/73
4,712,789 12/1987 Brilando ..... 272/73
4,712,790 12/1987 Szymski ..... 272/73

FOREIGN PATENT DOCUMENTS 0517774 2/1931 Fed. Rep. of Germany ..... 272/73

OTHER PUBLICATIONS

"Sabwinn" Fitness Equipment-Schwinn Air-Dyne Excelsior Fitness Equipment Copy.

*Primary Examiner*—Stephen R. Crow
*Attorney, Agent, or Firm*—Trask, Britt & Rossa

[57] ABSTRACT

An exercise cycle of the invention includes a frame, a seat, a pedal assembly, an air-resistance device, and a movable handlebar assembly. The crankshaft of the pedal assembly is attached to a first gear which is then in turn mechanically linked to the second gear and pivotally attached to the handlebars to cause an oscillating synchronous motion upon operation of the pedal assembly.

13 Claims, 8 Drawing Sheets

DUAL ACTION EXERCISE CYCLE

This application is a continuation in part of U.S. Design patent applications Ser. No. 07/201,130 and Ser. No. 07/201,129, both filed June 2, 1988.

BACKGROUND OF THE INVENTION

1. Field

The present invention is directed to an improved stationary exercise cycle.

2. State of the Art

Exercise cycles have been popular for many years. Such cycles enable the user to exercise in a manner similar to that when riding a bicycle, while conveniently remaining at home or in a gym.

Typical exercise cycles principally provide for aerobic conditioning effected by operation of the legs and lower torso of the user. Such cycles typically do not provide a substantial benefit to the arms and upper torso. Therefore, certain exercise cycles allow for motion of a handlebar assembly in some manner to provide exercise for the arms and upper torso of the user. Exercise cycles having a movable handlebar assembly are disclosed in U.S. Pat. No. 4,188,030 (Hooper), U.S. Pat. No. 4,509,742 (Cones), U.S. Pat. No. 4,657,244 (Ross), U.S. Pat. No. 4,712,789 (Brilando), U.S. Pat. No. 4,712,790 (Szymski), and U.S. Pat. No. 4,757,988 (Szymski). Each discloses handlebars which move back and forth out of phase with each other and synchronously with the pedaling action. Various gearing assemblies are disclosed in these references which provide for the synchronous and reciprocating motion of the handlebars. Brilando and Syzmski '790 disclose an offset sprocket (distinct from the main or primary sprocket) to which are eccentrically mounted a pair of drive arms. These drive arms are, in turn, mounted to pivoting handlebars.

For most exercise cycles, resistance to motion of the pedals or handlebar assembly is typically provided by, for example, an adjustable friction device, such as a friction belt or brake operating against a flywheel powered by the pedals or handlebar assembly. Air resistance to resist pedal or handlebar movement has also been found to be advantageous, since air resistance (drag) tends to increase with increased velocity, increasing the amount of resistance as the user pedals faster.

Typical exercise cycles have frames formed of tubes welded together in a shape similar to the frame of a standard bicycle. Such frames typically have a center bar or bars running between a seat post and a post to which the handlebars are attached. These center bars run between the user's legs. Such bars make it more difficult to mount the exercise cycle and may create a danger in the event a user should fall.

In addition, typical exercise cycles have a resistance device shaped roughly in the shape of a wheel and mounted generally in the position the front wheel of a bicycle would be mounted. Such front placement of the resistance mechanism may further inhibit ease of mounting and dismounting and may also increase the risk of engagement with the user or his clothing and risk of injury in the event of a fall. Also, if the front-mounted resistance mechanism is an air-resistance device, such as a fanlike structure, the mechanism may blow air in the user's face. While such air circulation may provide cooling, some users find that air being blown in their face is annoying.

Prior art cycles utilizing an air-resistance device typically use a secondary sprocket in order to provide sufficient gear reduction or gear ratio from the primary sprocket, which rotates about the crankshaft, and the sprocket which spins the air-resistance device. In order for a fan-like device to typically create enough resistance, the fan-like device must spin quite rapidly in comparison to the rotational speed of the main or primary sprocket. A typical gear ratio is approximately 11:1. In other words, the main or primary sprocket spins once for every 11 rotations of the sprocket directly connected to the fan-like structure. In order to accomplish this gear ratio, typical prior art cycles employ a secondary sprocket. A chain links the primary sprocket to a small secondary sprocket rotatably mounted about a secondary shaft, which is in turn coaxially connected to a larger secondary sprocket. This larger secondary sprocket is in turn connected by means of a second chain a smaller sprocket connected to the fanlike device. The use of such secondary sprockets with their secondary shaft and second chain has the disadvantage of increasing the amount of noise produced by the mechanism. Such structure also increases overall weight and increases the number of sprockets and chains which may become entangled with the user or his clothing.

Prior art cycles having a moveable handlebar assembly use various gearing assemblies to drivingly interconnect the pedal assembly with the handlebar assembly. One device utilizes a pair of drive bars which connect to either a crank ring and eccentric or crank arm which operates directly about the crankshaft and which then pivotally connect to and drive the pivoting handlebars. In this design the eccentric or crank arms and drive bars operate in close proximity to the user's legs, providing dangers of engagement with the user's legs or clothing and a less attractive appearance. Another design includes a system of gears associated with a front-mounted resistance device. A pair of roller devices are mounted eccentrically on one of the gears and associate with the pivoting handlebars to provide for driving of the resistance device upon operation of the handlebars. This design also presents an exposed gearing system with potential increased hazard and a less attractive appearance.

There is a need for an exercise cycle which has a frame to facilitate mounting and dismounting in addition to having air resistance and other selectable features to enhance its desirability and utility.

SUMMARY OF THE INVENTION

An exercise cycle of the invention includes a frame, a seat adapted to the frame, and a pedal assembly mechanically associated with the frame. A rotatable wheel is mounted to the frame and means is mechanically linked with the pedal assembly to resist operation of the pedal assembly. A single endless loop mechanically links a drive sprocket attached to the crankshaft with driven sprocket of the rotatable wheel. A first gear means is mechanically linked with the pedal assembly for operation about a first rotational axis. A second gear means is associated with the frame and mechanically linked with the first gear means for operation about a second rotational axis which is distinct from the first rotational axis. A pair of handlebars are associated with the frame to movably operate with respect to the frame. A pair of drive arms are mechanically linked with the second gear means and are each pivotally attached to a respective one of the handlebars at a respective first pivot point to urge operation of the handlebars upon operation of the pedal assembly.

The single endless loop means is a single chain which engages with a pair of sprockets linked with the crankshaft and the resistance means. Each of the handlebars is pivotally attached to the frame at a second pivot point. Each of the first pivot points may be at a fixed distance spaced from its respective to pivot about in handlebar axis.

The first and second rotational axes may be parallel. The first gear means and the second gear means may be sprockets mechanically interconnected by a chain. Alternatively, the first and second gear means may be toothed gears. The pedal assembly may include a crankshaft which has a rotational axis which is the same as the first rotational axis.

The exercise cycle may further comprise connection means for drivingly interconnecting the second gear means to the first gear means. The connection means may have a first position in which the second gear means and the first gear means are drivingly interconnected and a second position in which the second gear means and the first gear means are drivingly disconnected. The exercise cycle may further comprise operating means for moving the connection means between the first and second positions.

The second gear means is a gear concentrically and rotatably mounted upon a first shaft. The first shaft may be eccentrically and rotatably mounted upon a second shaft. The operating means may be a handle mechanically associated with the first shaft to rotate the first shaft about the second shaft to operate the connection means between its first and second positions.

In another embodiment, an exercise cycle of the invention includes a frame, a seat adapted to the frame, and a pedal assembly associated with the frame for operation by the feet of a user. The pedal assembly may include a crankshaft having a first rotational axis and a pair of foot pedal arms associated with the crankshaft to be engaged by the feet of a user and to operate about the first rotational axis. Rotating resistance means may be associated with the frame and mechanically linked with the crankshaft for resisting operation of the pedal assembly. A single chain interconnects the crankshaft with the resistance means by engagement with a pair of sprockets linked with the crankshaft and the resistance means. First gear means may be associated with the crankshaft for rotation about the first rotational axis. Second gear means may be associated with the frame and mechanically linked with the first gear means for rotation about a second rotational axis which is distinct from the first rotational axis. A pair of handlebars may be sized and adapted to be operated by the hands of a user. Each of the handlebars may be pivotally attached at a second pivot point to the frame. A pair of drive arms may be pivotally associated with the second gear means at a preselected offset distance from the second rotational axis. Each of the drive arms may be also pivotally associated with a respective of one of the handlebars at a first pivot point which is at a fixed offset distance from the second pivot point.

The first rotational axis and the second rotational axis may be parallel. The first and second gear means may be sprockets which are mechanically linked by means of a chain. Alternatively, the first and second gear means may be toothed gears which are mechanically linked by means of gear teeth. This embodiment may include connection means and operating means for moving the first and second gear means between a first engaged position and a second disengaged position.

The resistance means may resist operation of the pedal assembly by means of air drag. The resistance means may be adapted to the frame rearward of the pedal assembly. The resistance means may be partially enclosed by a housing associated with the frame. The housing may include an air direction member formed to direct air in a preselected direction. This preselected direction may include a direction toward the user positioned on the seat means.

DETAILED DESCRIPTION OF THE ILLUSTRATED EMBODIMENT

Figure 1:
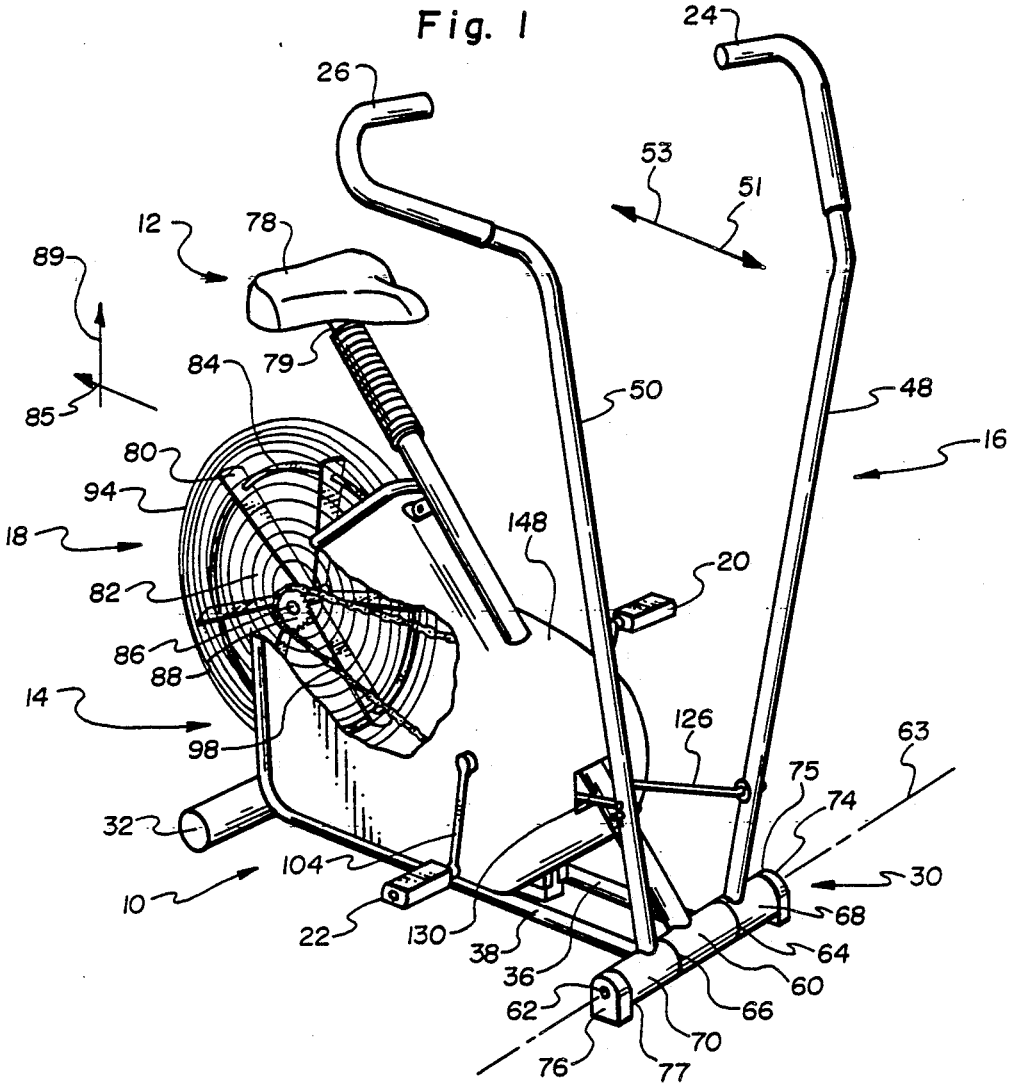
FIG. 1 is a perspective, partial cutaway, view of an exercise cycle of the invention.

Referring to FIG. 1, an exercise cycle of the invention includes a frame or frame means generally indicated at 10, seat means generally indicated at 12, drive means generally indicated at 14, handlebar means generally indicated at 16, and air resistance means generally indicated at 18. Drive means 14 includes pedals 20 and 22. Handlebar means 16 includes handles 24 and 26. A user positions himself upon seat means 12 facing in the direction of handlebar means 16. The user places his feet upon pedals 20 and 22, and grasps handles 24 and 26. The user then operates pedals 20 and 22 and handles 24 and 26 to exercise upon the cycle. Resistance to such operation is provided by resistance means 18. Use of the cycle is more completely described hereafter.

Figure 4:
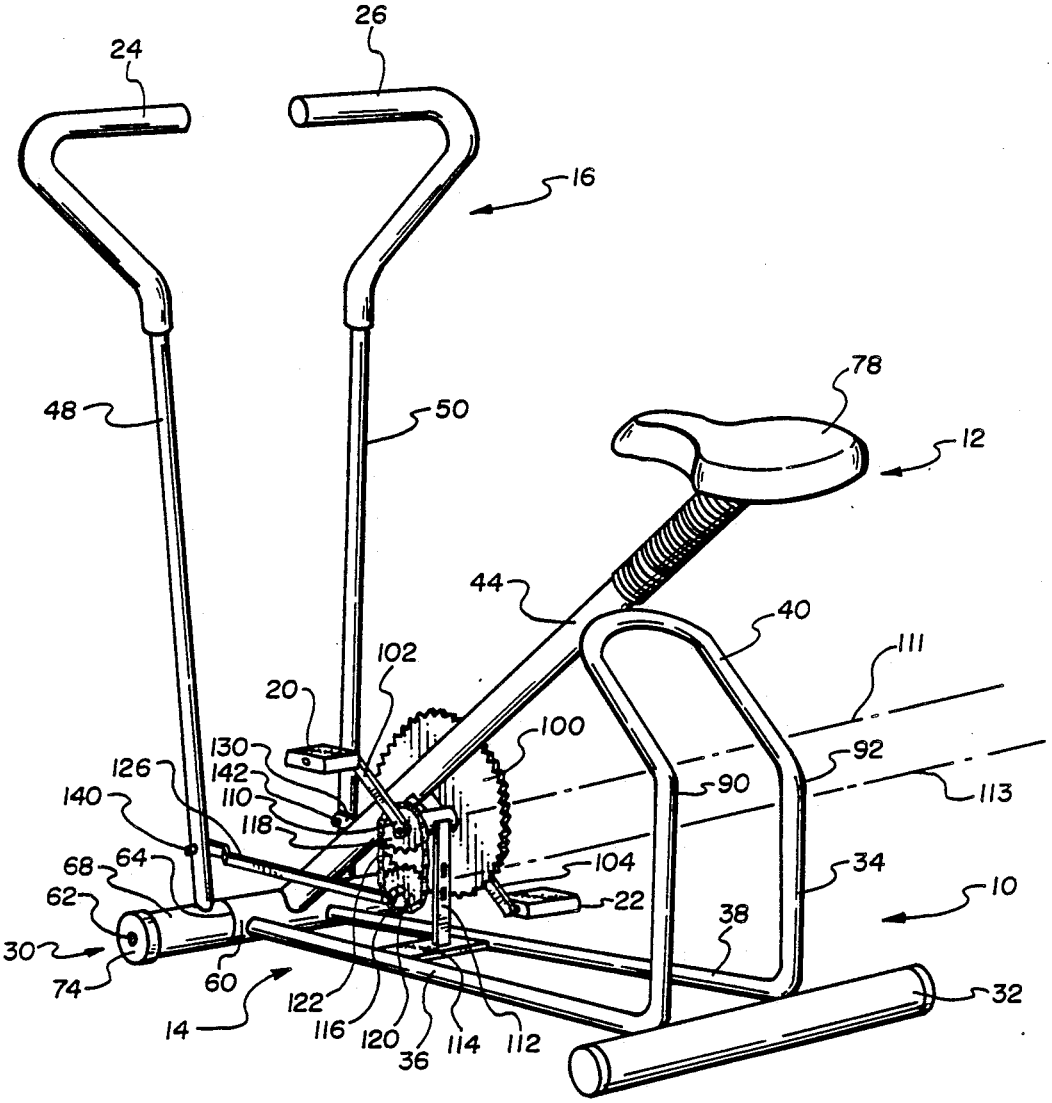
FIG. 4 is a perspective view of an exercise cycle of the invention with various parts removed.

The frame means 10 includes a front support unit generally indicated at 30 and a rear support unit 32. As shown in FIG. 4, a tubular frame member 34 provides a connection between the front support unit 30 and the rear support unit 32. As shown, tubular frame member 34 is bent to form a left lower tubular frame piece 36 and a right lower frame piece 38. Extending upward from these lower frame pieces is a curved frame portion 40.

Tubular frame member 34 and the curved portion 40 may be unitarily formed of any appropriately rigid material, such as steel or appropriate alloys, e.g. of aluminum or magnesium.

A seat support member such as diagonal member 44 is connected between front support unit 30 and frame portion 40, as shown. Diagonal member 44 is preferably formed of the same or similar materials as member 34, but is preferably of greater cross-sectional dimension to provide greater strength. Frame portion 40 is attached to and supports diagonal member 44.

The handlebar means 16 includes a left tube member 48 and a right tube member 50. Left and right tube members 48 and 50 are also preferably formed of the same or similar materials as member 34 and are bent to form handles 24 and 26, respectively. Handles 24 and 26 may be appropriately covered with a comfortable grip material such as a thin polyurethane foam.

Lower frame portions 36 and 38 form interconnecting member means which connect front support unit 30 to rear support unit 32. Lower frame portions 36 and 38 connect to a trunnion 60 (FIG. 1). A shaft 62 runs through and is connected to trunnion 60 and extends laterally away from it. Shaft 62 constitutes an illustrated embodiment of shaft means adapted to trunnion 60. Trunnion 60 has a left side 64 and a right side 66. (Right and left are determined from a view taken by a person operating the exercise cycle.) A left sleeve 68 is mounted pivotally upon shaft 62 to rotate about shaft 62. Similarly, a right sleeve 70 is mounted on the other end of shaft 62 to pivotally rotate about shaft 62. Left sleeve 68 and right sleeve 70 constitute an illustrated embodiment of sleeve means adapted to shaft 62 to rotate relative to trunnion 60.

Left tube member 48 is mounted to left sleeve 68 and right tube member 50 is mounted to right sleeve 70, as shown. Thus, left and right tube members 48 and 50 are allowed to pivot forward 51 and back 53 about shaft 62 which has an axis 63 which is also the handlebar axis. The tube members 48 and 50 pivot about the handlebar axis to provide a movable handlebar means 16.

The left end of shaft 62 is firmly fixed to a left foot 74, which has an inside bearing surface 75 which contacts left sleeve 68. The right end of shaft 62 is firmly fixed to a right foot 76, which has an inside bearing surface 77 which contacts right sleeve 70. Left and right feet 74 and 76 are connected to shaft 62 by any convenient means, for example, by being press fit or by, for example, a hex key. Left and right feet 74 and 76 serve to hold sleeves 68 and 70 upon shaft 62 and also serve to register with a support surface to keep left and right sleeves 68 and 70 above the support surface so that they do not frictionally contact the support surface, which would hamper the moving action of left and right tube members 48 and 50.

In the embodiment of FIG. 1, left and right feet 74 and 76 are roughly "D" shaped, and shaft 62 is firmly fixed to trunnion 60. Thus, left and right feet 74 and 76 provide a set of fixed feet to register in a non-moving relation with the support surface. In the embodiment of FIG. 4, left and right feet 74 and 76 are cylindrical or wheel shaped, and shaft 62 rotatably associates with trunnion 60. Left and right feet 74 and 76 have a diameter slightly larger than that of left and right sleeves 68 and 70. Feet 74 and 76 thus provide a pair of rolling wheels. A user picks up the rear end of the cycle, by for example lifting on seat 78 and then may use the wheels 74 and 76 to conveniently roll the cycle along the floor to the desired location.

As shown, the seat means 12 of the illustrated embodiment is comprised of seat 78 which is mounted at the distal end 79 of diagonal member 44 in a manner well known in the art. The handlebar means 16, in the illustrated embodiment, including left and right tube members 48 and 50, extend upwardly from the front support unit 30 to define, in combination with the diagonal member 44, a triangular-shaped empty space which would be forward of the user positioned upon seat 78 and oriented toward the forward end of the exercise cycle.

The empty space between the diagonal member and the handlebar means allows for ease of mounting and dismounting from the exercise cycle, and reduces risk of injury, especially for elderly and very young users.

Air resistance means 18 is comprised of a plurality of vanes 80 mounted to a hub 82 and spaced apart by a circular member 84. Each of vanes 80 has a distal end 85. Circular member 84 constitutes an illustrated embodiment of stiffener means. Hub 82 spins about axle 86, which is mounted to a sprocket 88. Axle 86 is mounted to tubular frame portion 40 at approximately bends 90 and 92 (FIG. 4) in a manner not shown but in a manner well known in the art. In the illustrated embodiment, axle 86 and hub 82 constitute illustrated embodiments of a support means which is adapted to frame means 10 to allow rotational motion of vanes 80 about hub 82. Vanes 80 constitute an illustrated embodiment of fan means. A protective cage 94, preferably formed of wire, envelops vanes 80 to preclude a user's clothing or any portion of his body from being struck by vanes 80 as they rotate about axle 86.

Sprocket 88 is connected to a chain 98 which is, in turn, connected in a manner well known in the art to a larger sprocket 100 (see FIG. 4). Rotational pedaling motion of pedals 20 and 22 causes, via chain 98, sprocket 88 and in turn vanes 80, to rotate about axle 86. Vanes 80 encounter air resistance as they spin about axle 86, thus causing resistance to be delivered to the pedaling motion of pedals 20 and 22.

Sprocket 100, pedal levers 102 and 104, pedals 20 and 22, crankshaft 110, chain 98, axle 86 and sprocket 88 constitutes a first drive means. Crankshaft 110 is rotatably mounted to diagonal member 44 by means of journal bearings attached to member 44 and strut member 112. Strut member 112 is mounted to a brace 114 which is, in turn, mounted between connecting members 36 and 38.

Attached to the ends of crankshaft 110, in a manner well known in the art, are pedal levers 102 and 104. Pedals 20 and 22 are mounted to pedal levers 102 and 104 respectively in a manner also well known in the art. Pedal lever 102 and pedal 20, and pedal lever 104 and pedal 22, respectively, constitute an illustrated embodiment of pedal means or foot pedal arms to be engaged by the feet of a user. These foot pedal arms in combination with crankshaft 110 constitute a pedal assembly, or pedal structure. Crankshaft 110 rotates about a first rotational axis 111.

A shaft or axle 116 is rotatably mounted to strut member 112 in a manner described hereafter. Shaft 116 is mounted to have its longitudinal axis 113 substantially parallel to the longitudinal axis 111 of crankshaft 110. Rotatably attached to crankshaft 110 is a sprocket 118. Attached to shaft 116 is a sprocket 120. A chain 122 drivingly connects sprocket 118 to sprocket 120 so that upon rotational pedaling motion of pedals 20 and 28, sprockets 118 and 120 move synchronously.

Figure 5:
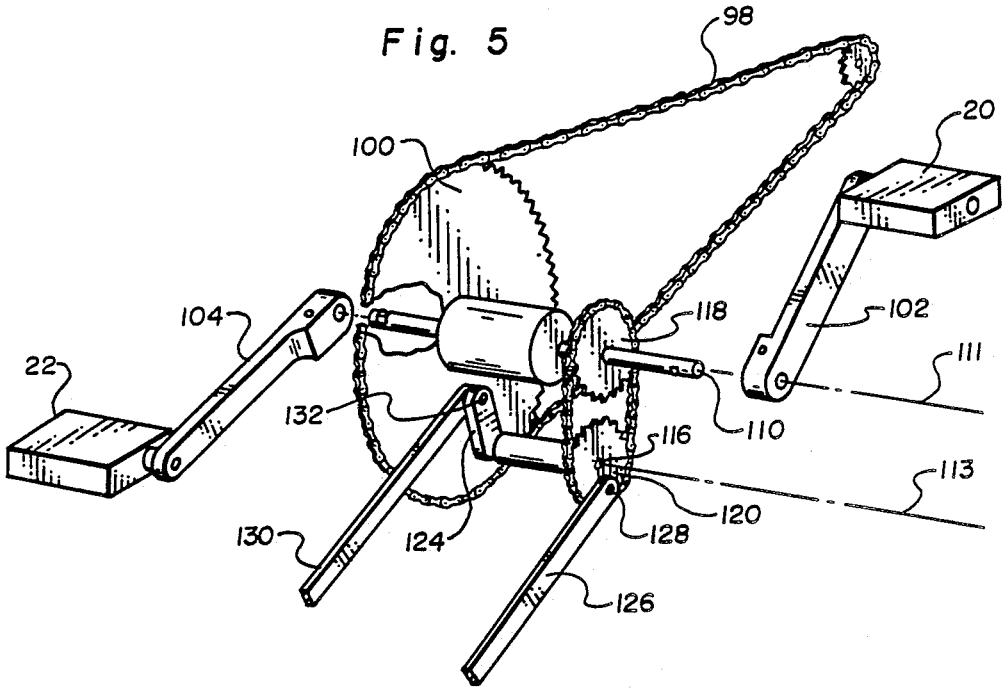
FIG. 5 is a perspective schematic view of a first and second gear means assembly of the invention.

FIG. 5 is a schematic view of a first and second gear means assembly of the invention. As stated, sprocket 120 is attached to shaft 116. Attached to the opposite or right end of shaft 116 is a drive lever 124. A drive arm 126 is pivotally attached at pivot point 128 to sprocket 120. Pivot point 128 is at a preselected distance from axle 116. Drive arm 130 is pivotally attached at pivot point 132 to drive lever 124. Pivot point 132 is at the same preselected distance from crankshaft 116 as pivot point 128 is from shaft 116, except that pivot point 132 is 180° in the opposite direction from or out of phase with pivot point 128. Sprocket 118 constitutes a first gear means or first gear of the invention. Sprocket 120 constitutes a second gear means or second gear of the invention. The rotational axis 113 of sprocket 120 about shaft 116 constitutes a second rotational axis.

Figure 7:
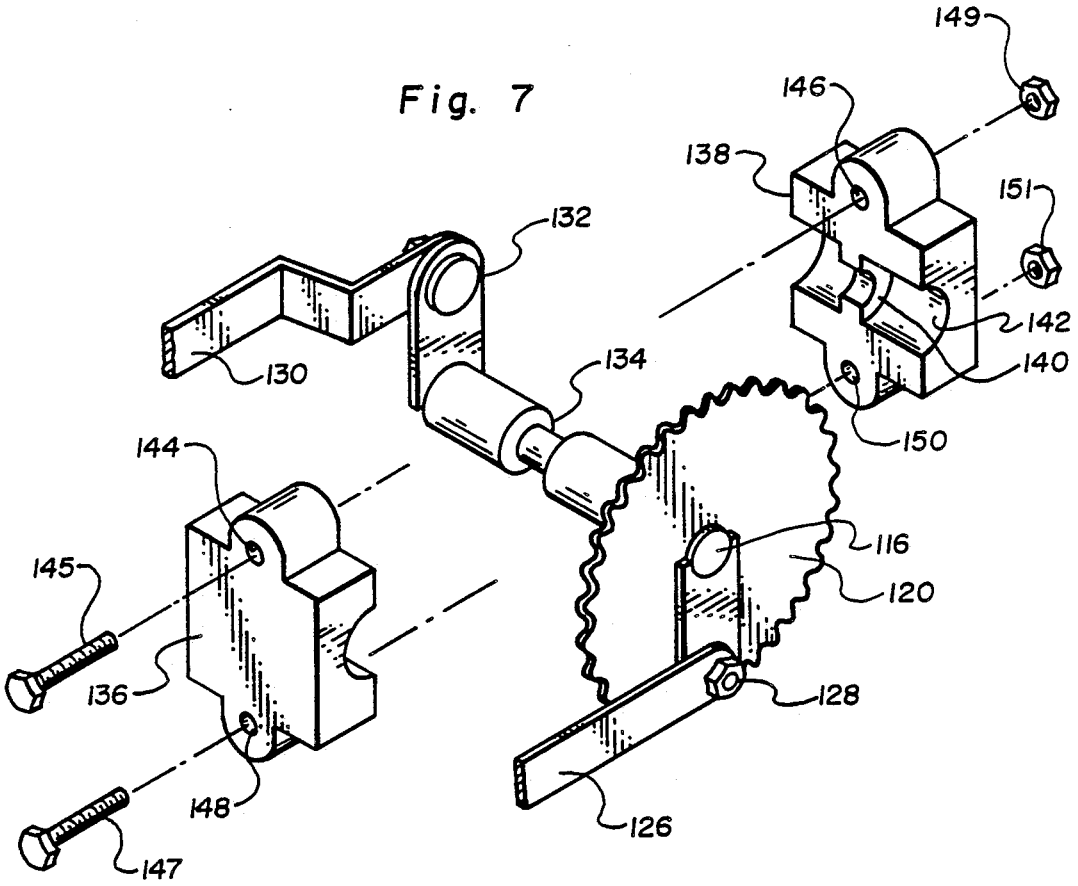
FIG. 7 is a perspective schematic view of a bushing and shaft assembly of the invention.

The attachment of shaft 116 to strut member 112 is illustrated in more detail in FIG. 7. As shown, a cylindrical notch 134 is formed in the exterior of shaft 116. A pair of bushing halves 136 and 138 each have a semi-cylindrical shoulder, of which the shoulder 140 in bushing half 138 is typical. Semi-cylindrical shoulder 140 along with the associating semi-cylindrical shoulder in bushing half 136 combine when bushing halves 136 and 138 are placed together to register with cylindrical notch 134 to hold shaft 116 in a fixed lateral position but allowing shaft 116 to rotate about its longitudinal axis. Interior semi-cylindrical surface 142 registers with the outside surface of shaft 116. Bushing half 136 contains a similar surface which also registers with shaft 116. A bolt 145 is passed through hole 144 and hole 146 into strut member 112, and similarly, a second bolt 147 passes through hole 148, through hole 150 and similarly into strut member 112 to firmly attach the bushing formed by the combination of bushing halves 136 and 138 to strut member 112 by tightening nuts 149 and 151 respectively. Bushing halves 136 and 138 are preferably formed of "oil light" material which is a material formed by combining powdered metal such as steel or brass and a lubricant under high pressure to form a lubrication impregnated metal, thus creating a metal bushing which may be said to be "self lubricating."

Referring again to FIG. 4, drive arm 126 is pivotally connected to left tube member 48 at pivot point 140, and drive arm 130 is connected to right tube member 50 at pivot point 142. As pedals 106 and 108 are operated in a rotational pedaling motion, sprocket 120 is caused to rotate as described, in turn, causing drive arms 126 and 130 to actuate in a generally forward and back motion, oscillating 180° out of phase with each other. The forward and back motion of drive arms 126 and 130 cause left and right tube members 48 and 50 to oscillate forward and back, toward and away from the user 180° out of phase. In other words, as the user operates handles 24 and 26 forward and backward in oscillating fashion, tube members operate drive arms 126 and 130 forward and backward to drive sprocket 120 and hence sprocket 118 to drive resistance means 18. Pivot points 140 and 142 each constitute first pivot points. The points about which tube members 48 and 50 each pivot about shaft 62 constitute respective second pivot points.

The position of sprocket 120 relative to sprocket 118 determines the relative phase of the pedaling motion of pedals 106 and 108 with respect to the oscillation of the left and right tube members 48 and 50. This relative phase of motion can be adjusted to accomplish varying effects upon the exercise provided by the machine. For example, the relative orientation of sprockets 118 and 120 can be arranged such that each of the left and right tube members 48 and 50 move toward the user when its respective pedal, i.e. pedal 20 or 22, respectively, are moving downward. Alternatively, the sprockets 118 and 120 can be oriented such that each of the left and right tube members 48 and 50 move away from the user when its respective pedal, i.e. pedal 106 or 108 is moving downward. Sprocket 118, sprocket 120, chain 122, drive lever 124, and drive arms 126 and 130 constitute a second drive means.

As indicated, the primary sprocket 100 directly drives the air resistance sprocket 88 by means of a single chain 98. In other words, no secondary sprocket or system of sprockets is needed to provide the correct gear ratio between the primary sprocket 100 and the air resistance sprocket 88. Typical exercise cycles use a standard bicycle chain with an approximately ½" link. The smaller sprocket located on the air resistance device is typically about 2½" in diameter to provide approximately 16 teeth around the perimeter of the sprocket. It is important to have sufficient teeth around the sprocket to provide a smooth flow of the chain around the sprocket and to avoid excessive noise. A chain, with its multiple links, is essentially a polygon which conforms roughly to a loop shape as it engages around its sprockets. If an insufficient number of teeth are used on any given sprocket, the polygon-shaped chain creates a rough motion of the chain and can cause increased noise and uneven feeling in the pedaling. In order to accomplish an 11:1 gear ratio with a 2½" rear sprocket and a standard bicycle chain, the front or primary sprocket would need to be approximately 27½" in diameter to directly drive the rear sprocket. Such a large diameter front or primary sprocket is currently considered too large and unworkable. Therefore, exercise cycles having an air resistance mechanism typically utilize a secondary sprocket to allow for a smaller diameter primary sprocket and the desired gear ratio.

However, in the illustrated embodiment of the present invention, a number 25 chain is used. A number 25 chain is typically used for non-exercise machinery and has a ¼" shorter link, providing for a smoother flowing action. In addition, with such shorter links, a 16-tooth sprocket can be provided having a diameter of approximately 1½". This allows for a front or primary sprocket having a diameter of only 11½" to provide for a 10:1 gear ratio. Thus, the illustrated exercise cycle provides for a direct drive between the primary sprocket and the rear sprocket and removes the need for a secondary sprocket with its incumbent increased danger, weight, noise, and complexity. The assembly of primary sprocket 100, chain 98, and rear sprocket 88 of the illustrated embodiment provides for a smooth and simple direct drive system and provides for reduced noise, weight, and number of sprockets and chains, which inherently reduces risk of engagement with the user or his clothing.

Chain 98 constitutes an endless loop means which directly interconnect the pedal assembly or crankshaft 110 with the air resistance means 18 by means of engagement with main sprocket 110 and resistance means sprocket 88. Other embodiments of endless loop means are within contemplation. For example, chain 98 may be replaced with a fan-belt type loop which engages with a system of pulleys. Only a single endless loop means is utilized. No secondary gear-reduction sprocket system with a second chain or other endless loop means is used.

Figure 6:
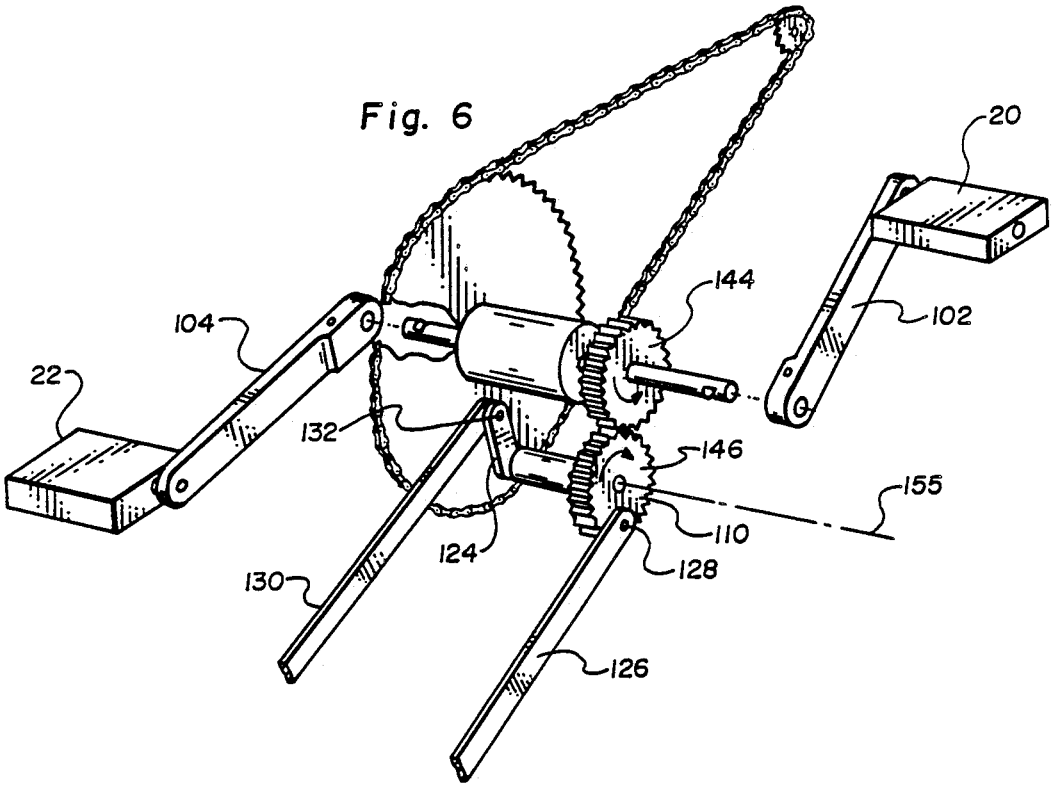
FIG. 6 is a perspective schematic view of an alternative embodiment of a first and second gear means assembly of the invention.

Another embodiment of a second drive means of the invention is illustrated in FIG. 6. Instead of the linked system of sprockets of FIG. 5, sprocket 118 (FIG. 5) is replaced by a toothed gear 144. Sprocket 120 is replaced by a toothed gear 146, which is identical to toothed gear 144. In FIG. 6, toothed gear 144 and toothed gear 146 intermesh with each other so that upon rotation of toothed gear 144, toothed gear 146 rotates in the opposite direction. Gear 144 constitutes a first gear means, and gear 146 constitutes a second gear means. The axis of rotation 155 of gear 146 constitutes a second rotational axis.

The opposite-direction rotation of toothed gear 146 with respect to toothed gear 144 is taken into account with regard to the relative phase motion of tube members 48 and 50 as pedals 20 and 22 are operated, as described, since this opposite rotation has the effect of reversing by 180° the phase of the forward and back motion of drive arms 126 and 130 with respect to the motion of pedals 20 and 22 as compared with the embodiment of FIG. 5. In a manner similar to a changing of the relative orientation of sprockets 118 and 120 described, the relative orientation of gears 144 and 146 may be altered to effect the relative motion of two members 48 and 50 with respect to the pedaling motion of pedals 20 and 22.

Figure 2:
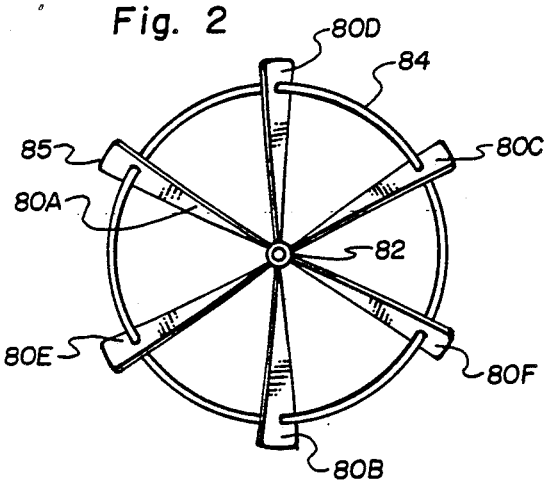
FIG. 2 is a plan view of a fan means of the invention.
Figure 3:
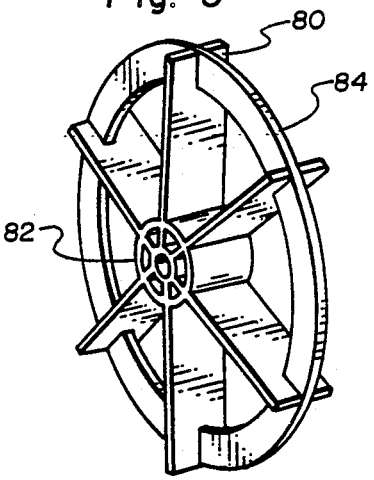
FIG. 3 is a perspective view of an alternative embodiment of a fan means of the invention.

Referring now to FIGS. 2 and 3, the orientation of vanes 80 is reversed every other vane. As shown, there are six vanes 80. Vanes 80 are attached to hub 82 which rotatably associates with axle 86. The vanes 80 are rigidly held by a circular support member 84 positioned proximate the distal end of each vane 80. Three vanes are oriented in one direction or with a left twist 80A, 80B and 80C and three are oriented approximately 90° in the other direction 80D, 80E and 80F. These reverse orientations cause air to be dissipated towards opposite sides of the exercise cycle in addition to being forced toward the back and up. If all of the vanes were oriented or twisted in the same orientation, air would be blown more strongly in one direction than another, thus exerting a force which would be resolved generally in the direction of axle 86 upon one side of the exercise cycle and in turn contribute to a phenomenon in which the machine tends to "walk" a little in one direction or another during use. The reverse orientation of the vanes, as shown in FIG. 2, precludes such a force from being delivered to either side of the exercise cycle and reduces the tendency to "walk."

In the embodiment of FIG. 3, vanes 80 are fixed transverse or perpendicular to the longitudinal axis of the exercise cycle. Vanes 80, supporting member 84, and hub 82 of the embodiment of the fan means of FIG. 3 are shown to be larger than the same elements of the embodiment of FIG. 2. The fan means of FIG. 3 may be formed of a rigid plastic to be lightweight and to provide a large amount of surface area for creating wind resistance or drag.

Referring back to FIG. 1, a housing 148 is mounted upon frame means 10 as shown to protect the user's legs, feet, or clothing from being engaged by moving sprockets, gears, drive arms, or chain. Housing 148 also forms a volute as shown, which affects the characteristics of the wind resistance delivered to resistance means 18. Housing 148, acting as an air direction means directs air rearward 84 and upward 89 of the exercise cycle. The upward direction 89 of the driven air provides a pleasant cooling effect to the user. Housing 148 constitutes a first housing means having a an air direction means portion.

Figure 8:
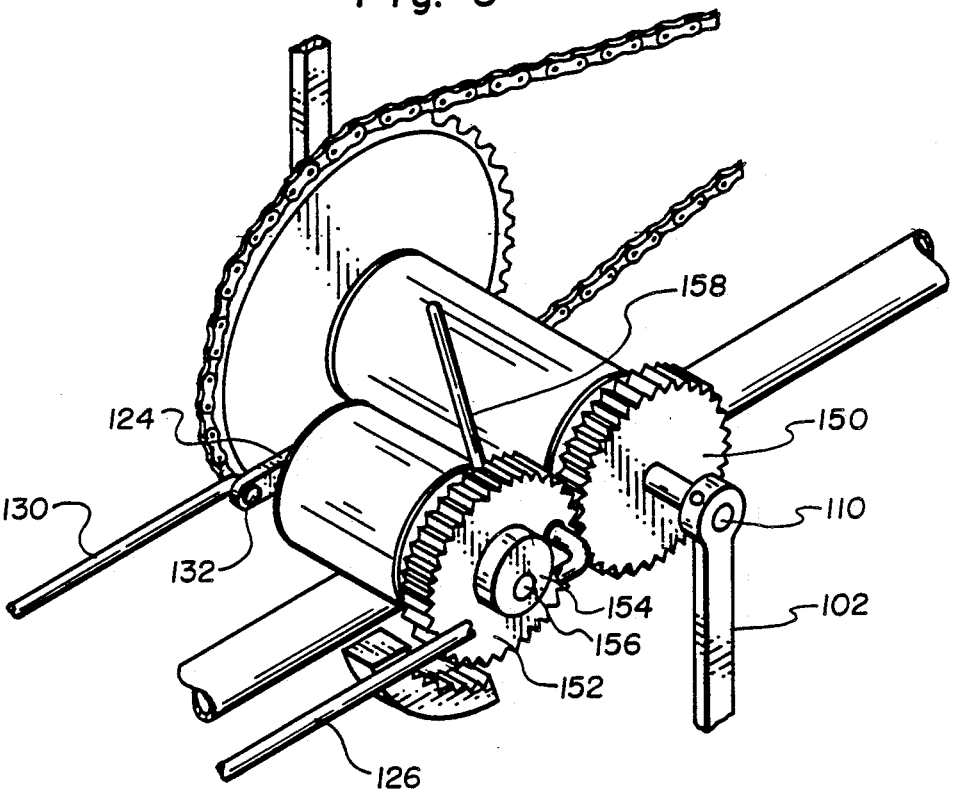
FIG. 8 is a perspective view of a connection means of the invention, with a first and second gear means of the invention in a first engaged position.
Figure 9:
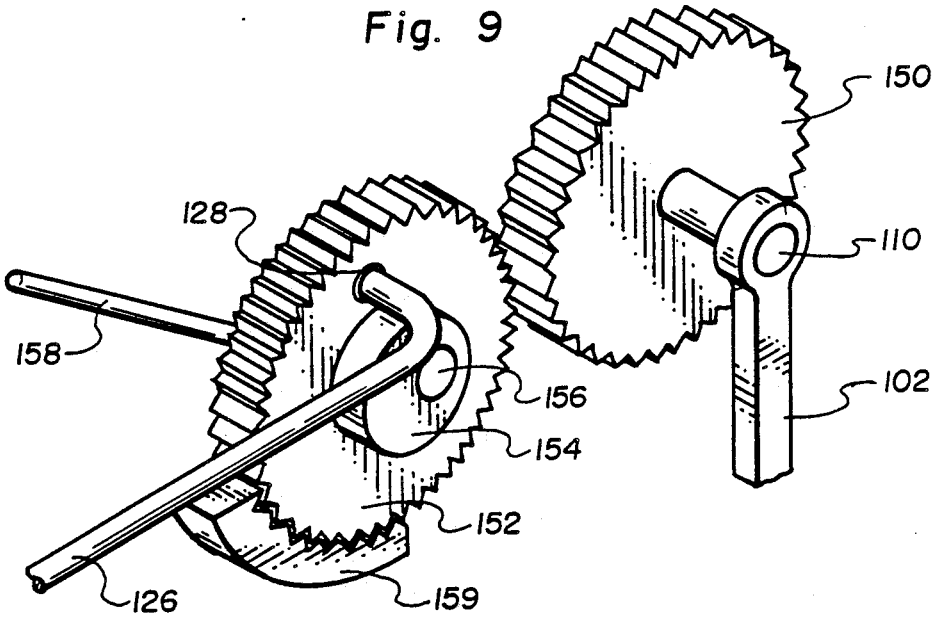
FIG. 9 is a perspective view of an embodiment of first and second gear means of the invention in a second disengaged position.

A connection means of the invention for selectively connecting the first and second drive means is illustrated in FIGS. 8 and 9. In the embodiment of FIGS. 8 and 9, first gear 150 is concentrically and firmly mounted upon crankshaft 110, as shown. Second gear 152 is concentrically and rotatably mounted upon first shaft 154. Shaft 154 has a larger diameter than crankshaft 110. Shaft 154 is eccentrically and rotatably mounted upon a second shaft 156, which is fixedly mounted, in a manner not shown, to the exercise cycle, such as, for example, to strut member 112, so as to provide a rigid and fixed position of shaft 156 relative to frame means 10.

Lever or handle 158 is mounted to shaft 154. When lever 158 is in the position shown in FIG. B, first gear 152 is in engagement with second gear 150. In this position gears 150 and 152 function in the same manner as gears 144 and 146 of FIG. 6. However, when lever 158 is moved to the position shown in FIG. 9, first shaft 154 is rotated about second shaft 156, which moves gear 152 away from crankshaft 110 to disengage gears 150 and 152. In this way, the reciprocating motion of tube members 48 and 50, and thus the reciprocating motion of the handlebar means 16, is disengaged from air resistance means 18.

Thus, the exercise cycle becomes one which provides exercise directed more limited to the legs and lower torso of the user. With gear 152 in the position shown in FIG. 9, gear 152 engages with the teeth of a fixed gear piece 159 to lock gear 152 from movement and to thus preclude tube members 48 and 50 from operating or pivoting about shaft 62. Gear piece 159 is fixedly mounted to strut member 112. The orientation shown in FIG. 8 constitutes a first position of the connection means, with first gear 150 and second gear 152 in a first engaged position. FIG. 9 shows a second position of the connection means with the first gear 150 and the second gear 152 in a second disengaged position. Lever 158 constitutes operating means.

The second gear means, e.g. sprocket 116 or gear 146, is advantageously spaced from the first gear means. If the drive arms 126 and 130 Were pivotally attached to sprocket 118 or gear 144, drive arms 126 and 130 and their associated gearing would necessarily be higher and closer to a user's legs. With the second gear means having a rotational axis distinct from the first gear means, the gearing assembly of the second gear means causes the drive arms 126 and 130 to oscillate out of the way of the foot pedal arms 126 and 130 and out of the way of a user's feet or clothing. Also, and the drive arms 126 and 130 are allowed to be positioned lower or away from the first drive means. In addition, the first and second gear means are advantageously located within housing 148. These factors increase safety and ease of mounting and dismounting, and improve appearance.

Figure 10:
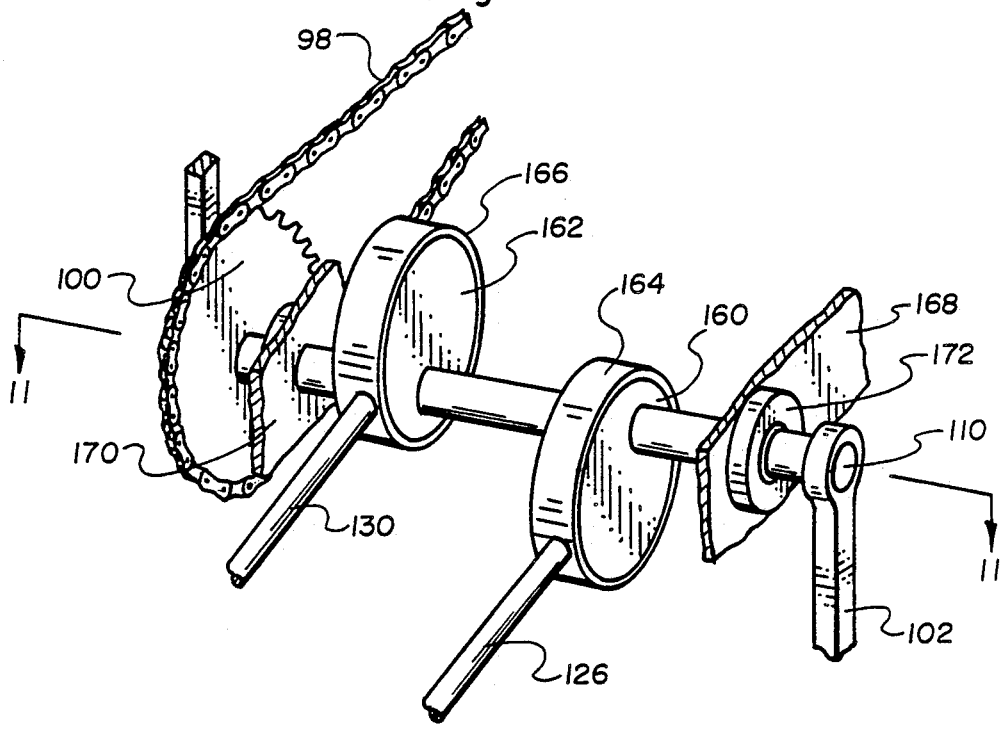
FIG. 10 is a perspective view of an alternate embodiment of a second drive means of the invention.
Figure 11:
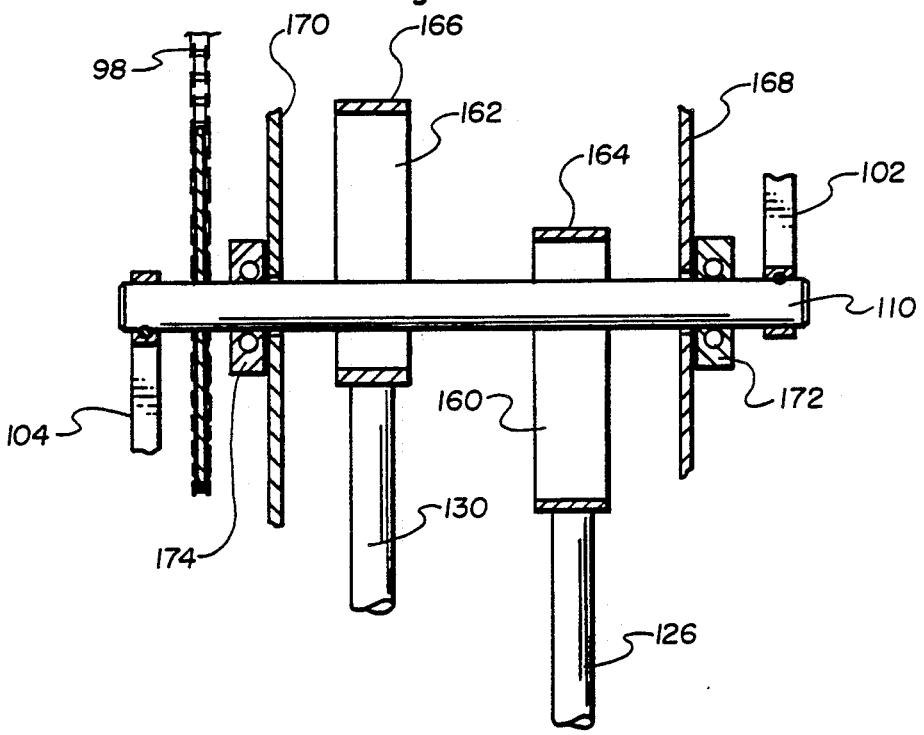
FIG. 11 is a section view taken along section 11—11 of FIG. 10.

Another embodiment of a second drive means of the invention is illustrated in FIGS. 10 and 11. In the embodiment of FIGS. 10 and 11, a pair of eccentrics 160 and 162 are firmly mounted upon drive shaft 110. In the embodiment of FIGS. 10 and 11, drive bars 126 and 130 are attached to a pair of collars 164 and 166 respectively which rotatably associate with eccentrics 160 and 162 respectively. Collars 164 and 166 are preferably bushings formed of "oil light" material to register in a reduced-friction manner with eccentrics 160 and 162. Eccentrics 160 and 162 are oriented 180 out of phase with respect to each other to provide the reciprocating motion of the handlebar means previously described.

Cutaway portions 168 and 170 represent portions of frame means 10, which connect, for example, to diagonal member 44 and/or to strut member 112. Portions 168 and 170 may be formed of an appropriately strong and rigid material, such as steel plate or alloy of aluminum or magnesium. A pair of roller bearings 172 and 174 are attached to portions 168 and 170 and rotatably associate with crankshaft 110. In the embodiment of FIGS. 10 and 11, bearings 172 and 174 constitute main bearings for crankshaft 110.

Figure 12:
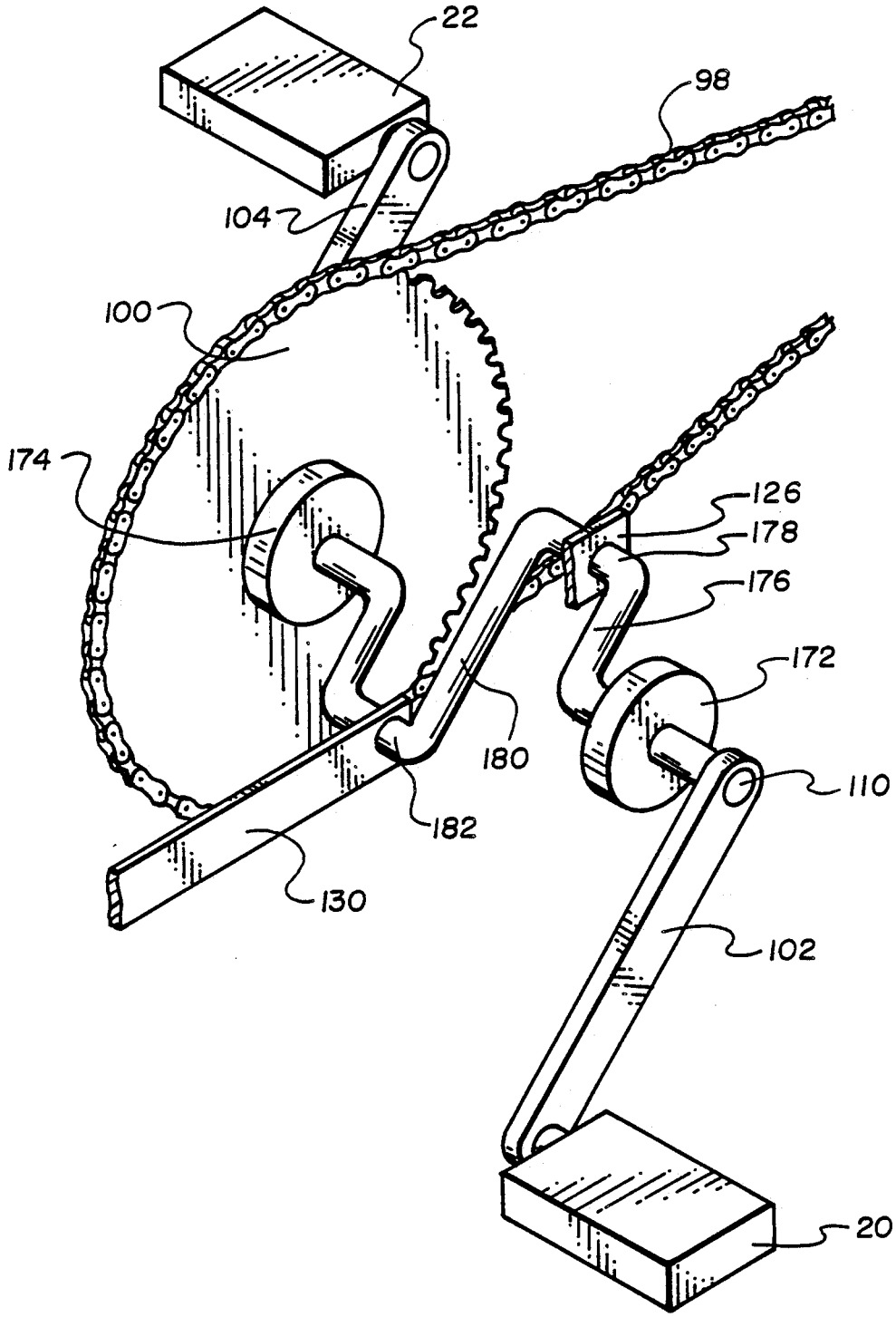
FIG. 12 is a perspective schematic illustration of another alternative embodiment of a second drive means of the invention.

FIG. 12 is a schematic illustration of another alternative embodiment of a second drive means of the invention. In the embodiment of FIG. 12, crankshaft 110 is formed in the double "U"-shaped configuration shown. Crankshaft 110 is rotatably associated with frame means 10 by means of bearings 172 and 174, which connect to frame means 10 by means of, for example, frame portions such as frame portions 168 and 170 of FIGS. 10 and 11. Crankshaft 110 is also formed to include a first "U"-shaped portion 176 having a generally linear distal portion 178. Crankshaft 110 is formed to include a second "U"-shaped portion 180 having a distal portion 182, as shown. Drive arms 126 and 130, in the embodiment of FIG. 12, are formed to be generally rectangular, as shown, and rotatably associate with distal portions 178 and 182, respectively, of crankshaft 110. "U"-shaped portions 176 and 180 are 180° out of phase with each other. Upon operational rotation of pedal arms 102 and 104 about crankshaft 110, "U"-shaped portions 176 and 180 cause drive arms 126 and 130 to oscillate forward and back to effectuate the oscillating forward and back operation of the handlebar assembly, as previously described. In other words, as the user pushes and pulls upon the handlebar assembly with his hands, drive arms 126 and 130 rotatably operate crankshaft 110 to in turn rotate sprocket 100 and, via chain 98, operate the resistance means 18.

Figure 13:
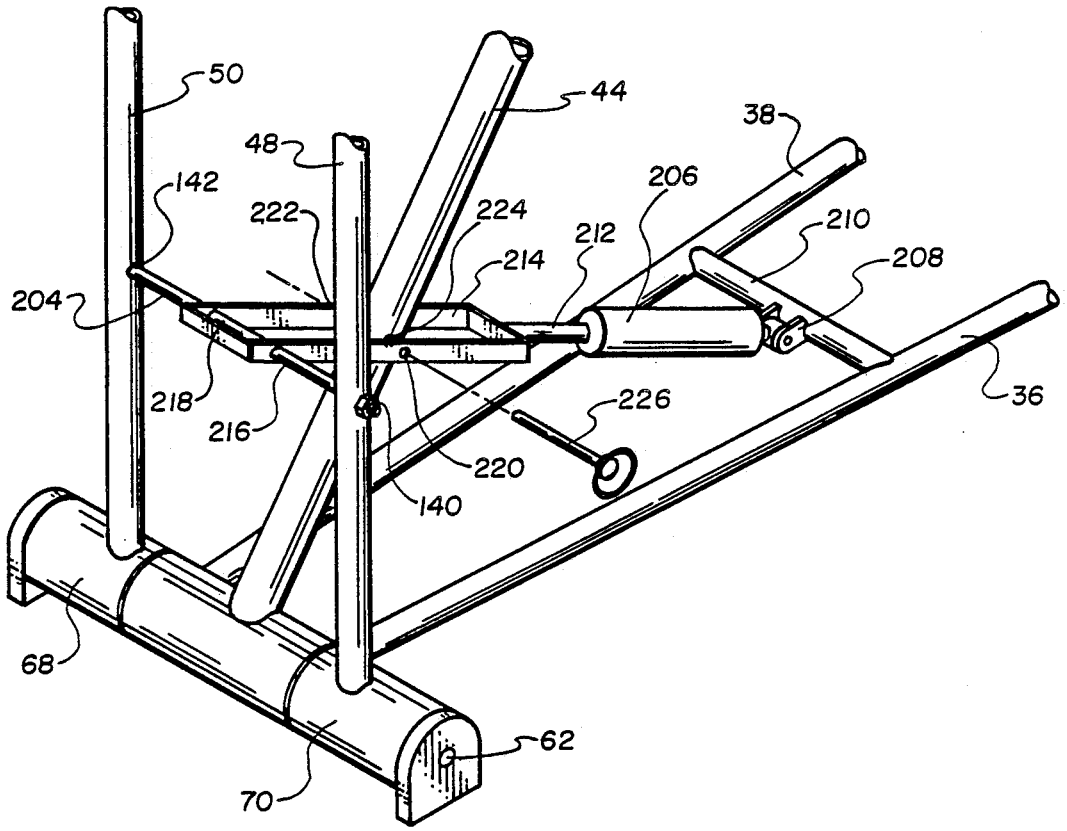
FIG. 13 is a partial perspective view of a second resistance means of the invention.

In the embodiment of FIG. 13, tube members 48 50 are locked in a position parallel to each other by a rod 204 which is firmly attached to tube members 48 and 50, at points 140 and 142 as shown.

A pneumatic cylinder or gas shock 206 constitutes a second resistance means and is pivotally attached at bracket 208 to a cross bar 210. The cross bar 210 is firmly attached to members 36 and 38, as shown. The point of attachment of pneumatic cylinder 206 to bracket 208 constitutes a second end of the second resistance means, which is attached to frame means 10. The piston rod 212 of gas spring 206 is attached to a square bracket 214 which is in turn pivotally attached at holes 216 and 218 to bar 200. The point of attachment of square bracket 214 to bar 204 constitutes a first end of the second resistance means, which is attached to the tubular member constituted by members 48 and 50. Thus, the user may grasp handles 24 and 26 to move tube members 48 and 50 toward and away from himself against the resistance of pneumatic cylinder 206.

Hole 220 and hole 222 (not shown) are formed in square bracket 214. A channel 224 is formed in horizontal member 44. Holes 220 and 222 and channel 224 are sized to receive a pin 226. When pin 226 is placed through holes 220, channel 224 and hole 222, square bracket 214 and thus tube members 48 and 50 are locked into a stationary position, thus providing a pair of stationary handlebars which the user may grasp while operating foot pedals 20 and 22. Thus, pin 226 and its registering holes formed in square bracket 214 and horizontal member 44, constitutes a locking means for the illustrated second resistance means of FIG. 12.

In use, a user seats himself upon the seat 78 and places his left and right feet upon pedals 20 and 22 respectively while grasping handles 24 and 26. The user, of course, faces forward in the direction of tube members 48 and 50. With the connection means in the first position, the user operates the pedals 20 and 22 and handles 24 and 26 in a reciprocating motion, as described, to operate air resistance means 18 to thus provide exercise to both the upper and lower torso of the user.

Thus, the resistance means 18 can be driven by either the pedal assembly, or the handlebar means 16, or both. The user can selectively vary the amount of exercise provided to either this upper or his lower torso. For example, the user can concentrate more on his legs by driving the pedal assembly to operate the resistance means 18 mostly with his legs, while letting his hands "coast", or loosely follow the oscillating motion of the handlebars. Alternatively, the user can concentrate more on his arms and upper torso by alternatively pushing and pulling on the handles 24 and 26 to drive the resistance means 18 while letting his legs "coast," or ride upon the pedals as they rotatably operate. Or, of course, the user can efficiently obtain more of a full body workout, and increase aerobic conditioning, by operating both the pedal assembly and the handlebar means 16 to drive resistance means 18. With the connection means in its second position, the user operates only the pedals 20 and 22 to provide conditioning exercise more limited to the legs and lower torso.

In a cycle of the invention including a second resistance means, with the locking means disconnected, the user may operate the pedals 20 and 22 while at the same time moving the handles 24 and 26 forward and back against the resistance of the second resistance means, while not necessary synchronously with the operation of pedals 20 and 22. With the locking means connected, the cycle performs as a standard exercise cycle having non-moving handlebars. In this way, an exercise cycle may be converted to vary the exercise provided according to the preference of the user.

Reference herein to details of the illustrated embodiment is not intended to limit the scope of the appended claims, which themselves recite those features considered to be essential to the invention.

We claim:

1. An exercise cycle, comprising:

a frame;

a seat adapted to said frame;

a pedal assembly mechanically associated with said frame and positioned for operation by the feed of user on said seat, said pedal assembly including a crankshaft having a first rotational axis;

a wheel rotatably adapted to said frame for resisting operation of said pedal assembly, said wheel having a driven sprocket;

a drive sprocket attached to said crankshaft for rotation about said first rotational axis;

a single endless loop drive means directly interconnecting said drive sprocket with said driven sprocket of said wheel;

first gear means mechanically linked with said crankshaft for rotation about said first rotational axis;

second gear means associated with said frame and drivingly linked to said first gear means for operation about a second rotational axis proximate to said first rotational axis;

a pair of handlebars each pivotedly attached to said frame to pivot about a handlebar axis, each handlebar having an upper portion with a handle for grasping by a user positioned on said seat and each having a lower portion extending downwardly and forwardly of said pedal assembly; and a pair of drive arms each mechanically linked with said second gear means and each pivotally attached to the lower portion of a respective one of said handlebars at a respective first pivot point above said handlebar axis distance to urge operation of said wheel upon operation of said handlebars.

2. An exercise cycle according to claim 1 wherein each of said handlebars is pivotally attached to said frame at its distal end.

3. An exercise cycle according to claim 1 wherein said first and second rotational axes are parallel.

4. An exercise cycle according to claim 3 when said first and second gear means are sprockets drivingly interconnected by a chain.

5. The exercise cycle of claim 2 wherein said wheel is rotatably adapted to said frame rearward of said pedal assembly.

6. The exercise cycle of claim 5 wherein said frame has a seat support member and wherein said handlebars and said seat support member together define a space to receive the legs of a user positioned on said seat.

7. An exercise cycle, comprising:

a frame;

a seat adapted to said frame;

a pedal assembly associated with said frame for operation by the feet of a user positioned on said seat, said pedal assembly including:

a crankshaft having a first rotational axis, a driving sprocket secured to said crankshaft for rotation thereabout, and a pair of foot pedal arms associated with said crankshaft to be engaged by the feet of a user and to operate said crankshaft about said first rotational axis;

a wheel associated with said frame for resisting operation of said pedal assembly, said wheel including a driven sprocket;

a single chain interconnecting said crankshaft with said wheel by engagement with said driving sprocket and said driven sprocket;

first gear means associated with said crankshaft for rotation about said first rotational axis;

second gear means associated with said frame and mechanically linked with said first gear means for rotation about a second rotational axis distinct from said first rotational axis;

a pair of handlebars sized and adapted to be operated by the hands of a user, each said handlebar being attached to said frame to pivot about a handle bar axis; and a pair of drive arms pivotally associated with said second gear means at a preselected offset distance from said second rotational axis, each of said pair of drive arms also being pivotally associated to a respective one of said handlebars at a first pivot point which is at a fixed offset distance from above said handlebar axis.

8. An exercise cycle according to claim 7 wherein said first rotational axis and said second rotational axis are parallel.

9. An exercise cycle according to claim 8 wherein said first and second gear means are sprockets which are mechanically linked by a chain.

10. An exercise cycle according to claim 7 wherein said wheel resists operation of said pedal assembly by means of air drag.

11. An exercise cycle according to claim 7 wherein said wheel is mounted on said frame rearward of said pedal assembly.

12. An exercise cycle according to claim 11 wherein said resistance means is partially enclosed by a housing associated with said frame, said housing including an air direction means formed to channel air in a preselected direction.

13. An exercise cycle according to claim 12 wherein said preselected direction includes a direction toward a user positioned on said seat.

* * * * *

UNITED STATES PATENT OFFICE

CERTIFICATE OF CORRECTION

Patent No. 5,000,444 Dated MARCH 19, 1991

Inventor(s) WILLIAM T. DALEBOUT; CURT G. BINGHAM

It is certified that error appears in the above-identified patent and that said Letters Patent is hereby corrected as shown below:

Title Page, column 2, line 8, change "Sabwinn" to ---Schwinn---

Column 2, line 55, delete "means".

Column 3, line 7, delete "at a second pivot point" and add ---to pivot about a handlebar axis---.

Column 3, line 9, delete "to pivot about in handlebar" and add ---second pivot point---.

Column 3, line 10, delete "axis".

Column 3, line 60, change to read as follows ---pivotally associated with a respective one of the---.

Column 9, line 66 delete "means" and add ---member---.

Column 10, line 2, delete "a".

Column 10, line 18, change "FIG. B" to ---FIG. 8---.

Column 11, line 2, after "180" add ---(a degree symbol) °---.

Column 12, line 56, delete "feed" add ---feet---.

UNITED STATES PATENT OFFICE

CERTIFICATE OF CORRECTION

Patent No. 5,000,444 Dated MARCH 19, 1991

Inventor(s) WILLIAM T. DALEBOUT; CURT G. BINGHAM

It is certified that error appears in the above-identified patent and that said Letters Paten is hereby corrected as shown below:

Column 11, line 42, insert ---and--- between 48 50.

Column 12, line 18, delete "this" add ---his---.

Column 12, line 41, delete "necessary" add ---necessarily---.

Column 13, line 22, delete "when" add ---wherein---.

Signed and Sealed this

Twenty-third Day of February, 1993

*Attest:*

STEPHEN G. KUNIN

*Attesting Officer*

*Acting Commissioner of Patents and Trademarks*